US005135232A

United States Patent [19]

Moreau

[11] Patent Number: 5,135,232

[45] Date of Patent: Aug. 4, 1992

[54] STRAP DEVICE FOR CARRYING RING TOSS GAME APPARATUS

[76] Inventor: Maurice R. Moreau, 85 Merryfield Dr., Scarborough, Ontario M4P 1K3, Canada

[21] Appl. No.: 694,375

[22] Filed: May 1, 1991

[51] Int. Cl.[5] ..... A63B 67/06

[52] U.S. Cl. ..... 273/336; 273/425

[58] Field of Search ..... 273/336, 424–425, 273/427, 337, 338, 339, DIG. 30; 224/901, 232, 250

[56] References Cited

U.S. PATENT DOCUMENTS 3,119,619 1/1964 Frank ..... 273/336

4,676,419 6/1987 Victor ..... 224/901

*Primary Examiner*—William H. Grieb

*Attorney, Agent, or Firm*—Charles P. Boukus, Jr.

[57] ABSTRACT

Disclosed is a strap device for storing or carrying ring toss game apparatus including two posts and four rings. The device has a first elongate strap and two second straps, one at each end which extends generally along the line of the first strap. The second straps are each adapted to be wrapped around parts of two rings and secured to the first strap. There are also two third straps. Each third strap extends perpendicular to the first strap and is adapted to be wrapped about an upper part of a post and secured with respect to the first strap. The lower part of each post is preferably located in a pocket at each end of the first strap. Each post has a step portion which enables the post to be forced into the ground by foot, the step also providing resistance to tilting of the post by contact by tossed rings.

10 Claims, 4 Drawing Sheets

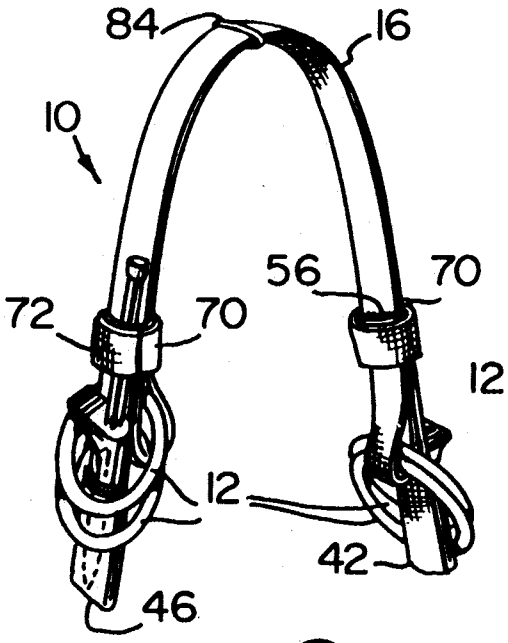
FIG. 12
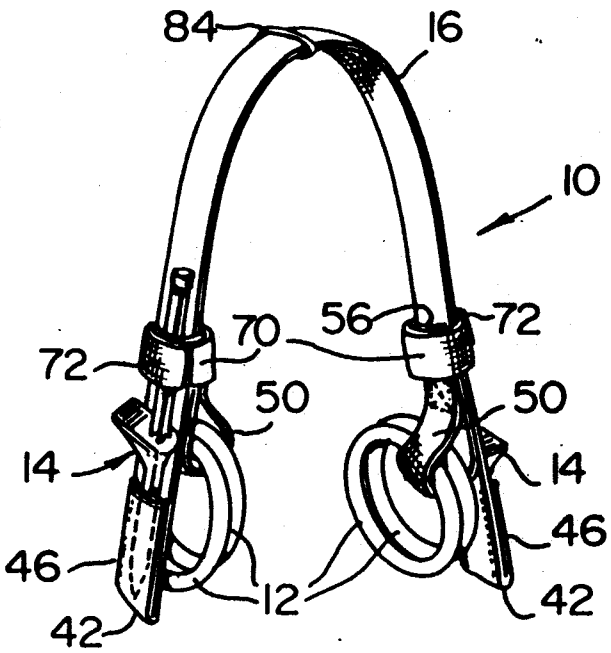
FIG. 1
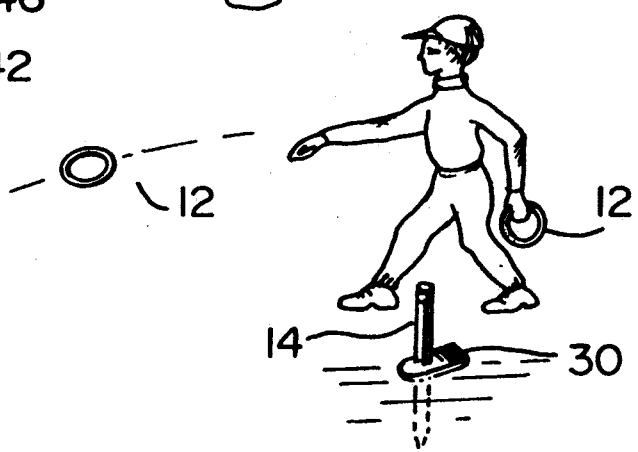
FIG. 2
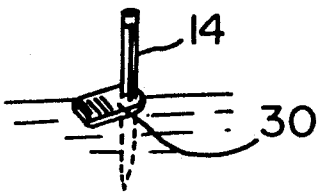

STRAP DEVICE FOR CARRYING RING TOSS GAME APPARATUS

FIELD OF THE INVENTION

This invention relates to game apparatus and more particularly to ring toss game apparatus and a strap which conveniently and easily permits carrying and storage of the game apparatus.

BACKGROUND OF THE INVENTION

Horseshoes is a game which has been known for many years and is played by teenagers and adults with great enjoyment and in sanctioned competition. For younger children, ring toss games have also been known for years and generally include rings made out of relatively strong but lightweight material adapted to be tossed at a post placed in the ground. Often there are two posts spaced a predetermined distance apart. Once the rings are tossed at one post, the players toss them back to the other post similar to horseshoes.

Although posts for horseshoes are fixed into the ground with an appropriate sand box periphery, ring toss games most often simply have posts which are supported vertically on the ground or posts which may be temporarily forced into the ground.

In any event and particularly when posts are removed from the ground, various parts of the apparatus for playing the game get separated, mislaid or lost. Further, it is often desired to carry or transport the apparatus to other locations, take it on a picnic or simply store it somehow off the floor.

With transportable games it can often be difficult to insert the posts into the ground. Further, although the posts may be inserted vertical, continuous contact by tossed rings will cause them to lose the desired vertical orientation and slant rearwardly.

Accordingly there is a need to provide a simple yet effective means for storing and carrying the various parts or elements of a ring toss game. Further, there is a need to provide posts which are more easily forced into the ground and ones which maintain the desired vertical orientation to a greater extent.

SUMMARY OF THE INVENTION

The invention in one aspect provides a device for carrying and storing apparatus for playing a ring toss game, the apparatus including at least one post and at least one ring although preferably there are two posts and four rings.

Preferably the device comprises an elongate first strap having a second strap and a third strap, the second strap adapted to encircle a part of the rings and be detachably secured to the first strap. The third strap is adapted to pass over an upper part of a post and be detachably secured by overlapping itself or to the first strap. A pocket in the first strap preferably holds the lower end of the post.

Another aspect is to provide posts which preferably include a step element integrally molded as part of the post which permits use of a foot in forcing the post into the ground. Further, when the posts are orientated in a desirable manner, the step element also assists in maintaining the vertical orientation of the posts notwithstanding repeated hits from tossed rings.

Thus broadly, the invention comprehends a device for storing or carrying a ring toss game having apparatus including at least one post and at least one ring. The device comprises an elongate first strap adapted to permit storing or carrying at least one post and at least one ring together, the first strap having means adjacent one end for removably securing a post thereto and means for removably securing at least one ring thereto.

Also, the invention provides a post for a game of ring toss or the like, the post is preferably integrally molded and comprises an elongate member having an axis. A step element is intermediate the ends of the elongate member and extends generally perpendicular to the axis, the step element providing means whereby the post may be manually forced into the ground. The step element is also configured such that when it is in contact with the ground, it assists in maintaining the post vertical notwithstanding being repeatably contacted by tossed rings.

Other aspects and features of the invention will become apparent from the detailed description of a preferred embodiment of the invention.

BRIEF DESCRIPTION OF THE DRAWINGS

FIG. 1 is a perspective view of the ring toss game apparatus and strap in the storage or carrying position.

FIG. 2 is a schematic illustration of the playing of the ring toss game showing the preferred placement of the posts.

FIG. 12 is a perspective view similar to FIG. 1 of the ring toss game apparatus and step in a storage or carrying position wherein the lower portion of the rings overlie the lower parts of the associated posts. (FIG. 12 appears with FIG. 1).

DESCRIPTION OF THE PREFERRED EMBODIMENTS

Figure 3:
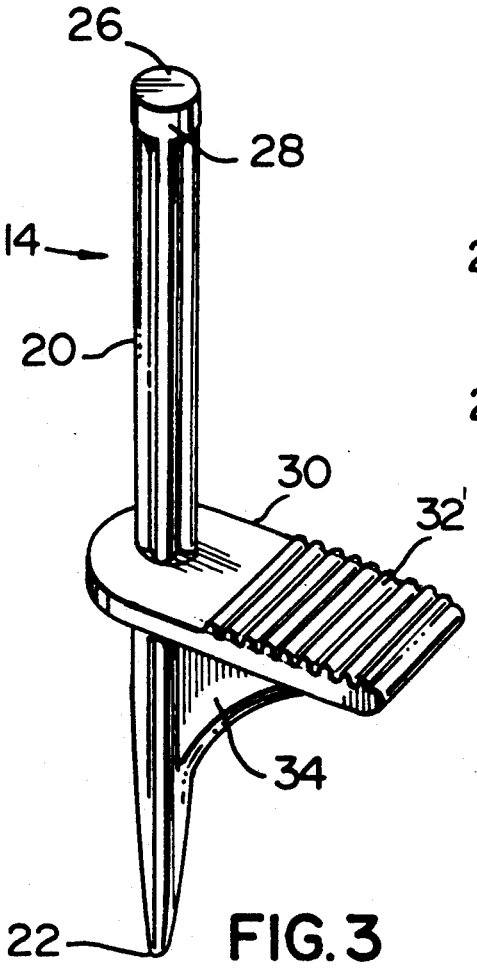
FIG. 3 is a perspective view of a post, the other post being identical.
Figure 4:
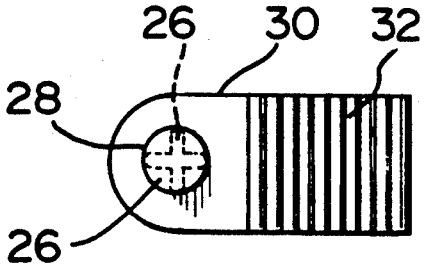
FIGS. 4, 5 and 6 are top, elevation and bottom views of the post of FIG. 3.
Figure 5:
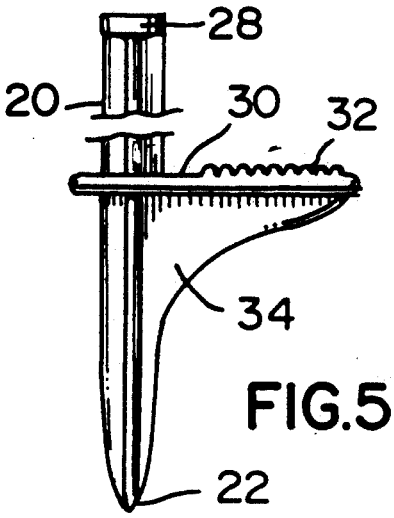
Figure 6:
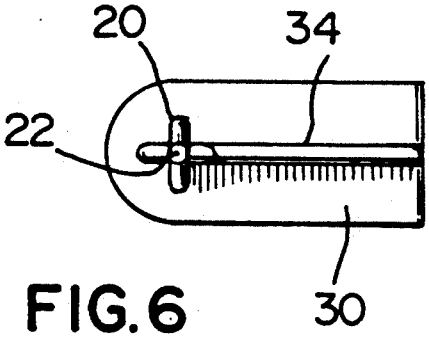

Turning to FIGS. 1 and 2, apparatus 10 to play, carry and store a ring toss game is shown, with FIG. 1 illustrating four identical rings 12 and two pegs or posts 14 secured in their respective locations for carrying the apparatus by strap 16. To play the game, the posts are located a predetermined distance apart, say 15 feet and one or more players toss two or more rings at one of the posts from adjacent the other post, all of which is generally known in the art.

Preferably the rings 12 are made of flexible rubber and are about 2.5 cm (1") thick with an inside diameter of about 11.5 cm (4½").

Each post or peg 14 is integrally molded of plastic material, preferably polypropylene about 29 cm long. Each post or peg 14, more particularly shown in FIGS. 3–6, has an elongate shank 20 of generally cruxiform cross-sectional configuration of about 1" cross-sectional extent. Shank 20 tapers to a point 22 at the lower end 24 and the upper end 26 is in the form of cylindrical cap portion 28. Intermediate ends 24 and 26 is a generally horizontal step element or shoulder 30 having a ribbed upper surface 32. Flange 34 provides added strength and permits the peg or post 14 to be forced into the ground by a foot placed on ribbed surface 32. Aside from flange 34 the underside of step 30 is flat and generally parallel to surface 32. Post 10 is preferably integrally molded polypropylene.

It will also be apparent from a review of FIG. 2 that if posts 14 are forced into the ground with step elements 30 facing away from each other, the step elements 30 provide added vertical support to the post and reduce the tendency of the respective post being forced into a rearwardly slanted position due to being repeatedly contacted by a tossed ring.

Figure 7:
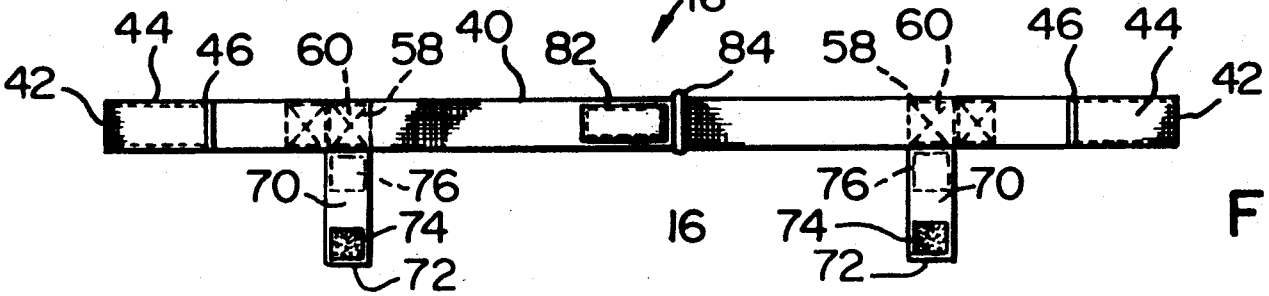
FIGS. 7, 8 and 9 are top, elevation and bottom views of the strap laid open.
Figure 8:
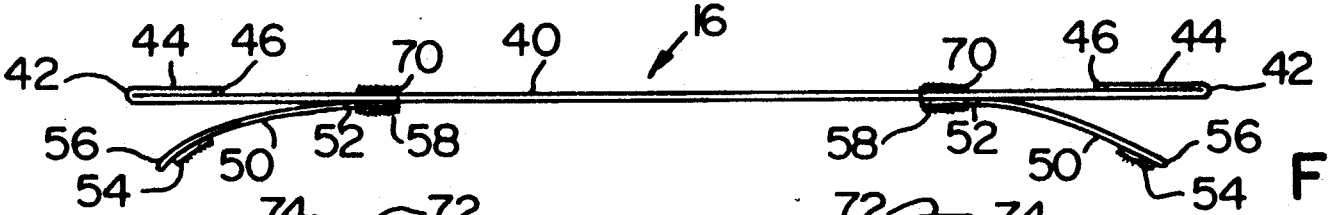
Figure 9:
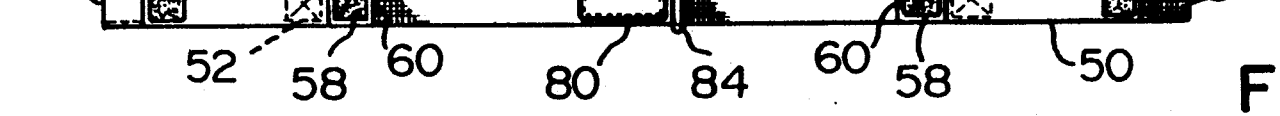

FIGS. 7, 8 and 9 show strap 16 laid out in the different positions and for purposes of discussion, they are referred to as top, elevation and bottom positions respectively.

Strap 16 comprises a longitudinal section 40 with opposed ends 42 having portions 44 turned up and sewn to form pockets 46, each pocket being adapted to accept and accommodate the lower pointed end 22 of a post 14. A ring strap 50 is secured by stitching at 52 to strap 40 inwardly of each end 42 and has fastener material 54 sewn to its free end 56. Cooperating fastener material 58 is sewn to strap 40 at 60 so that end 56 may be secured to strap 40 about two rings thereby holding the rings on a side of strap 40 opposite pocket 46. Fastener material 54 and 58 are the compatible hook and eye fastener materials of the type sold under the trade mark VELCRO®.

Extending perpendicularly from strap 40 at location 60 but under fastener material 58 is post strap 70 which has at its free end 72, fastener material 74, the fastener material being on the same side of the strap as pocket 42, as seen in FIG. 7. Strap 70 also has fastener material 76 secured to it by stitching or the like. Fastener material 76 is located adjacent fastener material 58 and on the other side of strap 70 from fastener material 74.

Figure 11:
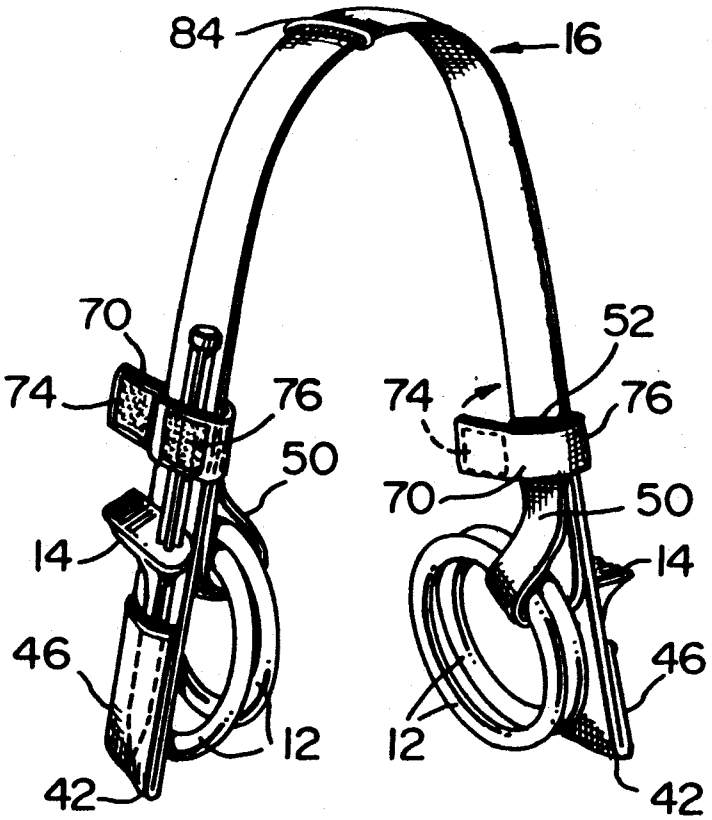
FIGS. 10 and 11 are views showing the securement of two rings and one post with the strap, the other two rings and post being similarly secured at the other end of the strap.
Figure 10:
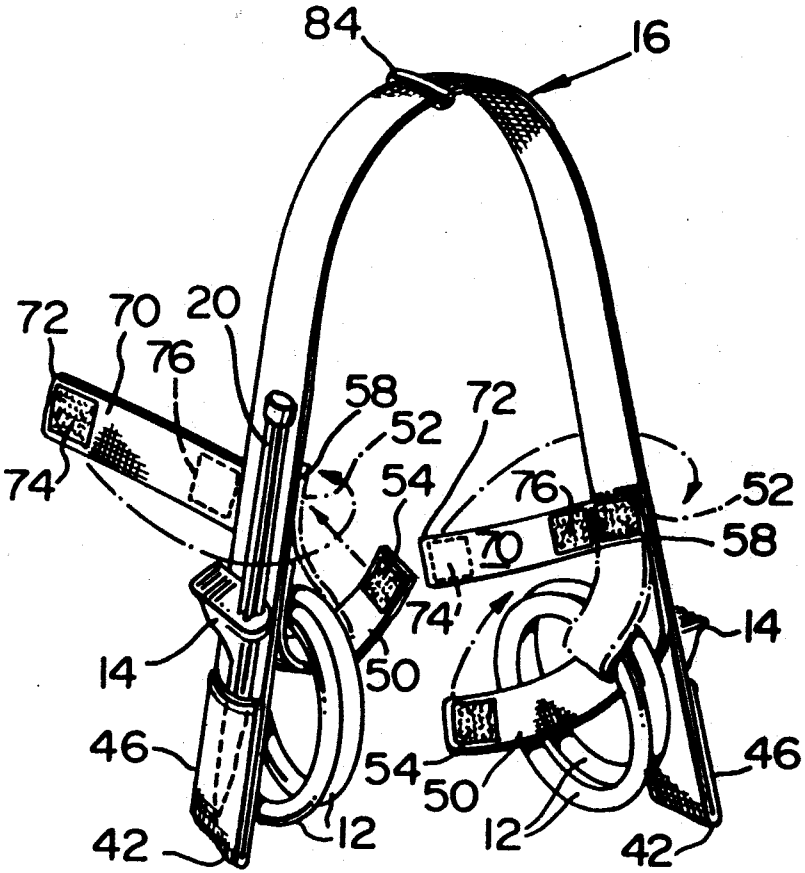

Turning to FIGS. 10 and 11, FIG. 10 shows two rings 12 being secured by each ring strap 50, the straps being passed through the rings and wrapped over a portion thereof with fastener materials 54 and 58 then being pressed together. FIGS. 10 and 11 show that after the rings 12 are secured by straps 50, posts 14 which have pointed ends 22 in pockets 46 are secured by wrapping a post strap end 72 over the upper portion of post shank 20, around the secured end 52 of associated ring strap 50 and securing post strap end 72 by pressing fastener materials 74 and 76 together. Thus post strap 70 reinforces the associated connection of the ring strap end 52 to strap 40, this being desirable in view of the relative weight of the rings. This reinforcement also reduces the tendency that swinging of the strap 40 with rings attached may cause ring strap fastener materials 54 and 58 to pull apart.

FIG. 12 is a perspective view similar to FIG. 1 but showing the lower portion of the rings 12 on the pocket side of the strap 16, the lower part 22 of the posts 14 and pockets effectively passing through the associated rings. This arrangement can be effected without difficulty when the posts 14 are being secured in place. The pockets 46 are pushed through the rings and the posts inserted and secured by straps 70. This arrangement maintains a compact unit at each end of the strap 16 and lessens further possible movement of the lower portion of the rings relative to the strap. This arrangement is also preferred for point-of-sale displays and storage.

Shown in FIG. 9 is label 80 which may contain the usual information as to the name of the game or the like, and/or the manufacturer's/distributor's name. Label 82 on the opposite side (FIG. 7) may include instructions on how to play the game. Further, the length of the strap 40 between ends 42 can be selected, such as 36" (3 ft), so that the strap, if desired, may be used to measure and set the distance between posts 14 in setting up the game.

FIG. 9 also shows a small (1" wide) piece of strap material 84 adjacent labels 80 and 82 which encircle the strap 16 or can be otherwise secured thereto. The purpose of strap 84 is simply to provide a means of hanging the device on a nail so that undue wear and tear on the strap 16 in the area of the labels 80, 82 containing the trade mark and/or instructions for playing the game is reduced. Strap 84 also permits point-of-sale hanging of the device if it is substantially all covered in plastic packaging material.

The strap 40 may be made of any flexible material but a polyester type rugged webbing such as polypropylene is preferred. All fastener materials are preferably of the hook-and-eye type (e.g. VELCRO®) but it will be appreciated that other types of fasteners such as dome fasteners could be used.

Although there has been set forth a preferred form of the invention, it will be appreciated by those skilled in the art that variations and modifications are possible within the concept of the invention and all such variations and modifications are claimed within the scope and spirit of the claims appended hereto.

The embodiments of the invention in which an exclusive property or privilege is claimed are defined as follows:

1. A device for storing or carrying a toss game apparatus including at least one post and at least one toss element, comprising:

an elongate first strap adapted to permit storing or carrying at least one post and at least one toss element together, said first strap having adjacent one end, means for removably securing a post thereto and means for removably securing at least one toss element thereto;

said means for securing said at least one toss element including a second strap secured at one end thereto to said first strap and having a free end, the free end of said second strap having means for detachable securement to said first strap, whereby said second strap may be detachably secured to said first strap about a portion of said at least one toss element;

said second strap extending longitudinally in the same direction as said first strap.

2. The device of claim 1 wherein said means for removably securing said at least one post to said first strap includes a pocket in the first strap for at least a part of said at least one post.

3. The device of claim 2 wherein said means for removably securing said at least one post to said strap also includes another strap, said another strap extending perpendicular to said first strap and adapted to pass over a second part of the post, said another strap having a free end having means whereby the free end can be detachably secured to said first strap or another portion of itself.

4. The device of claim 1 wherein said first strap has means for removably securing another post and means for removably securing at least one other toss element at the other end of said first strap.

5. The device of claim 3 wherein when said another strap free end is detachably secured to one of said first strap or another portion of itself, said another strap passes over the detachably secured free end of said second strap to reinforce its securement to said first strap.

6. The game of claim 1 wherein said toss element comprises a ring.

7. A game including at least one post and at least one toss element and further including a strap for carrying and storing said at least one post and said at least one toss element together;

said strap having means for removably securing said at least one post to one side of the strap adjacent one end thereof and having means on the other side of the strap to removably secure said at least one toss element to the strap such that the orientation of a secured toss element may be wholly on said other side of the strap or may be orientated so that a part of the secured at least one post and associated part of the strap passes through the at least one toss element.

8. The game of claim 7 wherein said post comprises an elongate member having an axis, a step portion intermediate the ends of said elongate member and extending generally perpendicular to said axis, said step portion providing means whereby the post may be manually forced into the ground.

9. The game of claim 8 wherein the step portion of said post is configured to be in contact with ground in which the post is forced and provide resistance to slanting movement resulting from contact by a tossed element.

10. The game of claim 7 wherein said toss element comprises a ring.

* * * * *